US006076335A

United States Patent [19]

Palm

[11] Patent Number: 6,076,335

[45] Date of Patent: Jun. 20, 2000

[54] METHOD FOR CALIBRATING A PACKAGING CONTAINERS

[75] Inventor: Lars-Erik Palm, Lund, Sweden

[73] Assignee: Tetra Laval Holdings & Finance S.A., Pully, Switzerland

[21] Appl. No.: 09/065,063

[22] PCT Filed: Nov. 5, 1996

[86] PCT No.: PCT/SE96/01420

§ 371 Date: Jul. 30, 1998

§ 102(e) Date: Jul. 30, 1998

[87] PCT Pub. No.: WO97/18995

PCT Pub. Date: May 29, 1997

[30] Foreign Application Priority Data

Nov. 20, 1995 [SE] Sweden ..... 9504127

[51] Int. Cl.[7] ..... B65B 1/22

[52] U.S. Cl. ..... 53/437; 53/436

[58] Field of Search ..... 53/436, 526, 527, 53/437, 525

[56] References Cited

U.S. PATENT DOCUMENTS

| | | | |
|---|---|---|---|
| 3,680,996 | 8/1972 | Ignell | 425/292 |
| 3,841,477 | 10/1974 | Stark et al. | 206/557 |
| 3,857,223 | 12/1974 | Dominici | 53/526 |
| 4,189,456 | 2/1980 | Ransing | 264/51 |
| 4,526,314 | 7/1985 | Reil | 229/106 |
| 4,922,688 | 5/1990 | Langen et al. | 53/437 |
| 5,143,764 | 9/1992 | Rosén | 428/36.5 |
| 5,228,270 | 7/1993 | Aarts | 53/432 |
| 5,255,842 | 10/1993 | Rosén | 229/137 |

FOREIGN PATENT DOCUMENTS

| | | |
|---|---|---|
| 227 068 | 5/1943 | Sweden . |
| 318 816 | 1/1957 | Sweden . |

*Primary Examiner*—Peter Vo
*Assistant Examiner*—Louis L. Huynh
*Attorney, Agent, or Firm*—Burns, Doane, Swecker & Mathis, L.L.P.

[57] ABSTRACT

Packaging containers for liquid contents, for example milk, are normally manufactured from laminated packaging material including a carrier or core layer of fiber material which is coated on each side with plastic layers. In order to facilitate folding of the material, this is normally provided with a pattern of weakening crease lines which facilitate the reforming into the desired packaging container configuration. A method of retroforming or calibrating a packaging container for realizing more accurate final configuration, sharper fold lines and thereby for imparting to the packaging container improved steadiness and stability comprises the steps of surrounding the packaging container (1) with a forming device (11) adapted to the final configuration of the packaging container, and of displacing parts (12, 13) of the forming device towards one another so that the free space for the packaging container is briefly reduced. An apparatus for carrying the method according to the present invention into effect comprises a forming device (11) with moving forming parts which, in the closed position, define a forming cavity of a volume which amounts to between 100 and 110 per cent of the theoretical minimum volume of a processed packaging container.

5 Claims, 1 Drawing Sheet

METHOD FOR CALIBRATING A PACKAGING CONTAINERS

TECHNICAL FIELD

The present invention relates to a method for retroforming, or calibrating, a sealed packaging container which is manufactured from flexible packaging material and which contains flexible, incompressible contents. The present invention also relates to an apparatus for retroforming, or calibrating, sealed packaging containers filled with liquid contents and of the type which are manufactured from flexible packaging material.

BACKGROUND ART

It is common practice in the food industry to pack liquid contents such as juice or milk in packaging containers of single-use disposable type which are manufactured from a flexible, liquid-tight packaging material. The substantially parallelepipedic packaging containers which are marketed under the brand name Tetra Brik® are described in greater detail in European Patent No. EP 91712, to which reference is now made, and are thus manufactured from a flexible packaging laminate which comprises a carrier or core layer of fibre material, for example paper, which is coated on each side with relatively thin layers of thermoplastic material, normally polyethylene. The packaging laminate may also include further material layers, such as barrier layers of metal or other barrier materials in order to provide improved protection against light or oxygen gas when particularly sensitive products are to be packed.

In the manufacture of the above-outlined prior art packaging containers, a packing or filling machine is employed which stepwise reforms a preferably web-shaped packaging laminate into individual, filled packaging containers. In order to facilitate the reforming process, the packaging laminate is provided with a pattern of fold or crease lines which are formed by pressing of the packaging laminate between rollers with cooperating ridges and depressions which, above all because of softening of the fibre layer, impart to the material a tendency to be folded along the weakened, linear areas created in this process. The reforming of the original, substantially cushion-shaped filled and sealed packaging containers into parallelepipedic form will hereby be facilitated. The so-called final forming above all comprises flat-pressing, inward folding and sealing of formed corner flaps to the outside of the packaging container, so that a substantially parallelepipedic configuration is achieved. Since, principally for economic reasons, attempts are made in the art to minimise the quantity of material included in the packaging laminate, the packaging laminate itself is relatively thin, with the result that the difference in folding tendency between the parts of the laminate provided with fold or crease lines and the unaffected parts is relatively slight. Consequently, the reforming of the packaging laminate into packaging containers and, in particular the so-called final forming operation may result in a packaging container which not always obtains the desired, well-defined edges and corners but tends to display a more rounded transitional area between the different wall surfaces of the packaging container disposed at angles to one another. A more undefined configuration further entails the disadvantage that the packaging container will, in the finished state, be perceived by the consumer as more markedly yielding and unstable, which may impede the consumer's handling of the packaging container, primarily in connection with pouring of the contents from the container.

The method and the apparatus according to the present invention may naturally also be employed in other, for instance prismatic configurations of packaging containers which are manufactured by folding and sealing of flexible packaging material.

There is thus a general need in the art to realise a packaging container of the above-outlined type possessing well-defined—or calibrated—configuration and improved steadiness and stability. With a view to realising this object, attempts have been made in the art to modify the packaging laminate by incorporating layers of different material types and properties, but this has however most generally entailed that the packaging laminate becomes more expensive. Trials have also been carried out with different types of crease or weakening lines, with the intention of realising a more manifest weakening of the material so that folding and forming are facilitated, but no tangible improvement has been achieved. In order to obtain a packaging container possessing well-defined or calibrated configuration and improved stability, one option which has been indicated in the art is to increase the thickness of the packaging laminate and, in particular, the fibre layer, which naturally entails increased costs and, as a result, has been put into practice to only a limited extent.

SUMMARY OF THE INVENTION

One object of the present invention is thus to realise a method of retroforming or calibrating a packaging container which is manufactured from flexible packaging material and contains preferably liquid contents, the method making it possible to obviate the above-outlined drawbacks and to realise a packaging container possessing considerably improved steadiness and stability as well as a better defined contour.

A further object of the present invention is to realise a method which makes it possible, by a simple and uncomplicated process, to calibrate a packaging container so that it assumes its predetermined configuration with a high degree of accuracy.

Yet a further object of the present invention is to realise a method of imparting to a packaging container sharp and well-defined edge lines and corners, whereby the appearance and stability of the packaging container are improved.

The above and other objects have been attained according to the present invention in that a method of the type described by way of introduction has been given the characterizing feature that the packaging container is surrounded by a forming device adapted to the desired final form of the packaging container, the forming device comprising forming parts which are moved towards one another so that the free space available for the packaging container is briefly reduced.

A further object of the present invention is to realise an apparatus for calibrating sealed packaging containers which are manufactured from flexible packaging material and are filled with liquid contents. The apparatus according to the present invention should further be of simple, dependable construction and be designed so as to be able to be integrated into existing packing machines for the production of, for example packaging containers of the Tetra Brik® type.

Still a further object of the present invention is to realise an apparatus of the above-outlined type which is economical to manufacture and operate and at the same time makes possible the reliable final forming or calibration of produced packaging containers.

The above and other objects have been attained according to the present invention in that an apparatus of the type described by way of introduction has been given the characterizing features that it comprises a forming device consisting of movable forming parts which are displaceable between an open and a closed position in which a cavity defined by the forming parts has a volume which amounts to between 100 and 110 per cent of the theoretical minimum volume of a processed packaging container.

The method and the apparatus as devised according to the present invention make for a final forming or calibration of per se known packaging containers, which imparts to the packaging containers a considerably better defined configuration and increased steadiness and stability and, as a result, improved consumer friendly handling. As a result of the temporary volume reduction undertaken in connection with the calibration process according to the invention, the packaging container is obliged to adapt to the inner configuration of the forming device, with the result that, in particular along the edge lines and corners of the container, the fibre layer of the material is given more clearly defined folds.

BRIEF DESCRIPTION OF THE ACCOMPANYING DRAWINGS

Preferred embodiments of both the method and the apparatus according to the present invention will now be described in greater detail hereinbelow, with particular reference to the accompanying schematic Drawings which show only those parts essential to an understanding of the present invention. In the accompanying Drawings.

DESCRIPTION OF PREFERRED EMBODIMENT

Figure 1:
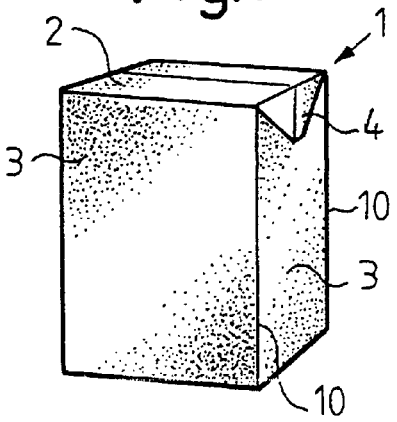
FIG. 1 is a perspective view of a prior art packaging container of a type in which the present invention may reduced into practice.

The method and apparatus according to the present invention are intended to be utilised for retroforming or calibrating a sealed packaging container which is manufactured from flexible packaging material and contains flexible and incompressible contents, with a view to imparting to the packaging container a better defined form with clearly marked "sharp" edge lines and corners, whereby the package is given greater steadiness and stability and also improved appearance. The method and the apparatus according to the present invention are described hereinbelow applied to a prior art packaging container of the parallelepipedic type (Tetra Brik®), whose design and construction, and also the manner of its manufacture, are disclosed in EP 91712, to which reference is now made. The method and the apparatus may naturally be applied to any given type of packaging container whatever, on the sole condition that the packaging material is sufficiently flexible to be physically influenced, and that the packaging container is wholly or partly filled with flexible and incompressible contents, for example contents containing a greater or lesser proportion of liquid.

A parallelepipedic packaging container 1 which has been selected for the purposes of illustrating the method and the apparatus according to the present invention comprises a substantially planar top 2, a similarly planar bottom (not visible) and four substantially planar side panels 3 disposed at right angles to one another. The packaging container 1 is produced by the folding, severing and sealing of web-shaped, flexible packaging laminate and, during the forming process, a surplus of material occurs which, in a per se known manner, is flat-laid into triangular corner flaps 4. Only one of these is visible in FIG. 1, since both of the corner flaps 4 located at the top end of the packaging container are, after the flat-pressing operation, folded downwards and sealed to two of the side panels 3 of the packaging container 1, while the packaging container's two corner flaps located at its bottom end have been flat-laid and sealed to the bottom surface of the packaging container which is not visible on the Drawing.

Like many similar packaging containers, the packaging container 1 is produced from a laminate packaging material 5 which, in order to facilitate folding and forming, has a number of fold or crease lines 6 which are disposed in the desired pattern over the surface of the packaging material. The fold lines 6 are realised in a per se known manner in that the material, prior to reforming into individual packaging containers, is caused to pass between two rollers which display the desired linear pattern in the form of male and female parts, respectively. The packaging material 5 includes a central, relatively thick carrier or core layer 7 of fibre or paper material which is coated on each side with relatively thin plastic layers 8, 9 of thermoplastic material, preferably polyethylene. The two plastic layers 8 and 9 serve, on the one hand, as liquid-tight layers and, on the other hand, as sealing material since, on reforming of the packaging laminate into individual packaging containers, they are utilised to make possible heat sealing of the packaging material.

Figure 2A:
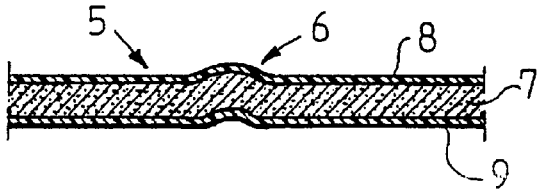
FIG. 2A shows, on a larger scale, a section through a part of a per se known packaging laminate provided with fold or crease lines.
Figure 2B:
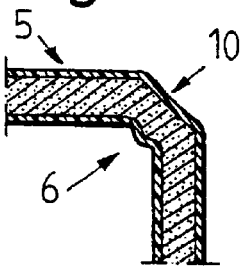
FIG. 2B shows the packaging laminate according to FIG. 2A after folding.

FIG. 2B shows the prior art packaging material according to FIG. 2A after folding through 90° along the fold line 6 which, for example, corresponds to a section through one of the vertical edge lines 10 of the packaging container 1 shown in FIG. 1. It will be apparent from FIG. 2B how the packaging material 5, after the folding operation, creates an edge line 10 possessing a relatively diffuse contour, which is intimately related partly to the structure of the core layer 7 of the packaging material 5, and partly to the relatively undefined forming operation which is at present employed for imparting to the packaging container the desired final parallelepipedic configuration. The overly indistinct form of the edge lines 10 has a negative effect on the appearance of the packaging container and moreover reduces the possibility of utilising the edge lines 10 as rigidifying "beams" in the largely flexible packaging construction.

Figure 3:
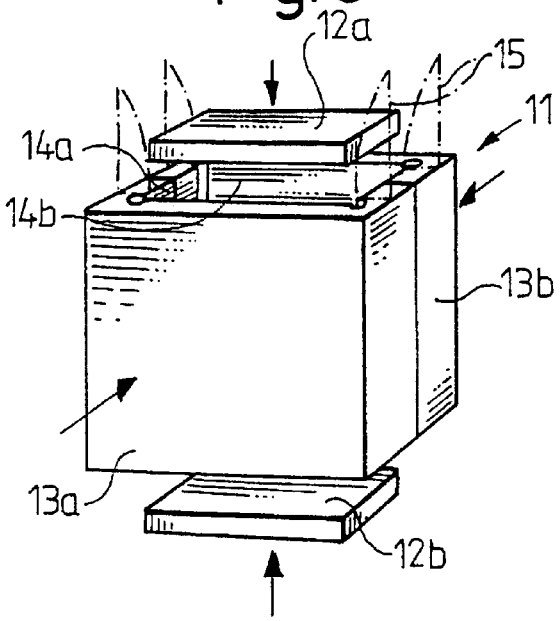
FIG. 3 is a perspective view of an apparatus according to the present invention.

When the method according to the present invention is put into practice in the packaging container 1 illustrated in FIG. 1, use is preferably made of a forming device 11 of the type which is illustrated in FIG. 3. The forming device comprises a number of mutually movable forming parts, namely substantially rectangular platformed upper and lower forming parts 12*a* and 12*b*, and two side forming parts 13*a* and 13*b* which are substantially U-shaped in cross section. The forming parts are mutually movable and may be displaced from an open to a closed position (indicated by means of the arrows in FIG. 4) and vice versa. The inner defining surfaces 14*a*, 14*b* which define the U-shape of the two side forming parts 13*a* and 13*b* define a space which is rectangular in cross section and whose size and form substantially correspond to the cross sectional configuration of the packaging container 1, as will be described in greater detail hereinbelow. The upper and lower forming parts 12*a* and 12*b* are of such size that, on displacement in the direction of the arrows, they may be moved towards and adapted to the space defined by the side forming parts 13*a* and 13*b* in order thus to compress the packaging container 1 located in the space, as will be described in greater detail below. At the upper region of the forming device 11, there are provided a number of folding or guide members 15 which are mutually movable, for example slidable or pivotal, in order on the one hand to facilitate infeed and discharge of a packaging container 1 in the forming device 11, and on the other hand to guide parts of the packaging container 1 in connection with the calibration (fold stamping) carried out by means of the forming device 11.

Figure 4:
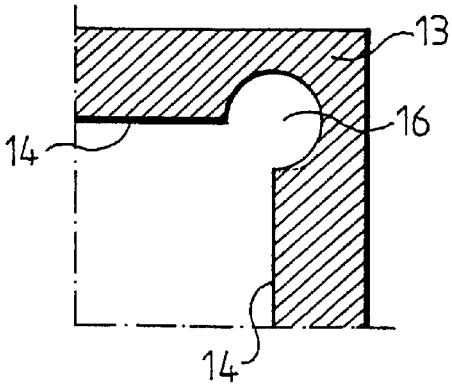
FIG. 4 shows, on a larger scale, a section through a part of the apparatus according to FIG. 3.

FIG. 4 is a section through a corner of a side forming part 13 included in the forming device 11 and illustrates how this displays, along its vertical corners, a recess 16 which is in the form of a groove of suitable cross section, e.g. substantially circular. However, other configurations are also conceivable. The recess is of a width of between 1 and 4 mm and its depth amounts to between 0.4 and 1.2 times the width of the groove. The placing of the recess 16 coincides with the fold lines 6 provided in the packaging material 5, which entails that the forming device 11 primarily displays recesses 16 along those vertical corners in which the edge lines 10 of a packaging container 1 under processing are located. However, recesses 16 in the form of grooves or surfaces of different geometric form may also be placed at other points in the forming device 11 if desired, in order, for example, to indicate or strengthen the packaging material around an opening region disposed in the packaging material at that part of the packaging container which serves as the gripping area or at any other part of the packaging container where the punched pattern created with the aid of the recess may serve either as the desired rigidification and/or as a decorative pattern included in the printed artwork on the packaging container.

Figure 5:
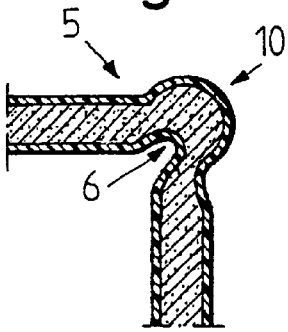
FIG. 5 shows, on a larger scale, a section through a folded portion of a packaging container in which the method according to the present invention has been applied.

FIG. 5 shows a section through the packaging material 5 at a part of the vertical edge line 10 of a packaging container 1 processed in accordance with the present invention. It will be apparent from this Drawing Figure how the edge line 10 has, by the method according to the invention, been given a considerably more manifest, projecting configuration which is also better defined and gives a "sharper" corner than is the case in prior art packaging containers (FIG. 2B). The appearance according to FIG. 5 is achieved in that, in accordance with the present invention, the packaging container—after its production in a per se known manner and, for example filled with liquid contents and sealed—is placed in the forming device 11 according to the invention. More precisely, the packaging container 1 is inserted with the aid of guide rails on which rest the corner flaps of the packaging container. The position of the packaging container will hereby be well-defined, whereupon the inner defining surfaces 14*a*, 14*b* of the forming parts 13*a* and 13*b* abut against the side panels 3 of the packaging container 1. In this position, the upper and lower forming parts 12*a* and 12*b*, respectively, are activated and displaced in the direction of the arrows towards the top 2 and bottom, respectively, of the packaging container 1. If necessary, the parts of the packaging container 1 (for example the corner flaps located in the bottom which are not visible on the Drawing) are guided with the aid of the folding and guide members 15, at the same time as the upper and lower forming parts 12*a* and 12*b*, respectively are brought into abutment against the top 2 and bottom, respectively, of the packaging container 1. The upper and lower forming parts 12*a* and 12*b* are displaced towards one another until the volume defined by the forming parts 12 and 13 has been reduced to between 100 and 110 per cent of the theoretical, minimum volume which the packaging container 1 (packaging material together with volume of contents) may accommodate (the lower percentage being in cases of packaging containers which are not entirely filled with liquid, i.e. which also contain a given quantity of compressible gas). On reduction of the free space for the packaging container, the packaging material 5 is forced, by deformation of the core layer 7 and the two outer plastic layers 8 and 9, into the recesses or grooves 16 disposed in the forming device 11 so that the fold or crease lines 9 are stamped and thereby reinforced and obtain the well-defined appearance which is illustrated in FIG. 5. After compression of the packaging container for a short period of time (typically of the order of approximately 1 second), the forming parts of the forming device 11 are once again opened so that the calibrated packaging container 1 may be removed from the forming device. By placing the forming device 11 as a part in a per se known packing and filling machine, the described processing of the packaging containers may take place as a part of the production cycle proper without necessitating any reduction of the speed or output rate of the machine.

Both the method and the apparatus according to the present invention may be modified in order, if necessary, further to optimise function. In calibration of packaging containers 1 of more complex configuration than the illustrated, parallelepipedic configuration, or in cases when the packaging container has an outer surface possessing a relatively high coefficient of friction, it may be appropriate, for facilitating the forming operation, to provide the inner defining surfaces 14 of the forming device 11 with a low friction material, for example tetra fluouroethene. In order further to facilitate the movement between the packaging material and the forming device 11, and to ensure that the packaging material 5 is formed to the greatest possible degree following the contour of the recesses 16, it is also possible to vibrate the forming device 11 during the compression operation, which may be effected by connecting the forming device 11 to a per se known vibrator apparatus. The closure together of the individual forming parts 12 and 13 of the forming device 11 may possibly also take place with a vibrating motion. The arrangement for guiding and displacing the different parts of the forming device 11 may be of per se known type and will not be described in greater detail in this context. Since, in packing and filling machines of the type which manufacture, for example, the packaging container illustrated in FIG. 1, use is often made of cam surfaces and bars for obtaining the desired well-defined movements, a similar technique may of course also be employed for obtaining the desired pattern of movement of the different forming parts 12 and 13. Naturally, other technology such as, for example, hydraulic or pneumatic means may also be employed with similar results. The two folding or guide members 15 are shown but schematically and, their design may be adapted to the needs that occur in the calibration of packaging containers of different types. When the packaging container includes parts which are not ready-folded, for example sealing fins, corner flaps or the like, the folding and guide members 15 may be designed so that they, in connection with or prior to closure of the different forming parts 12, 13 of the forming device 11, execute a rotary or linear movement in order to influence the packaging material in a direction towards the desired final position before the final compression takes place with the aid of the forming device 11. In those cases when heat sealing of corner flaps or sealing fins is to be carried out in connection with the calibration operation, hot air nozzles (not shown) or other heat generating devices are also utilised prior to the compression operation for heating the external thermoplastic layers 8 and 9 of the packaging material 5 to softening temperature within those regions where the sealing operation is to be effected. However, this technique is also well-known in the art and constitutes a freely available option for a person skilled in the art.

By realising the method and apparatus according to the present invention, an opportunity has been created for giving packaging containers manufactured from flexible packaging material a retroprocessing which imparts to the packaging container a well-defined configuration with straight, rigid contour lines with a certain relief effect, which not only imparts to the packaging container a neater appearance but has also proved to considerably improve the rigidity and consumer handling properties of the packaging container.

The present invention may be further modified without departing from the spirit and scope of the appended claims.

What is claimed is:

1. A method of forming a sealed packaging container comprising the steps of:

a) providing a laminate comprising a fibrous core layer coated on each side by a thin plastic layer with at least one fold line;

b) filling and sealing the laminate to form a filled, sealed container;

c) placing the container into a free space defined by a forming device comprising at least one side forming part having a recess constructed to define an edge line on the container; and d) bringing the laminate of the container into abutment with the side forming part by displacing the side forming part toward the container thereby reducing the free space.

2. The method of claim 1, wherein the free space is reduced to between 100 and 110 per cent of a theoretical minimum volume of the packaging container.

3. The method of claim 1, wherein the side forming parts of the forming device are vibrated in connection with the surrounding of the packaging container.

4. The method of claim 1, wherein the laminate is deformed into the recess.

5. The method of claim 1, wherein the laminate is brought into abutment with the side forming part solely by displacement of the side forming part toward the container.

* * * * *